United States Patent [19]

Kivi et al.

[11] 4,010,429

[45] Mar. 1, 1977

[54] COAXIAL DISC-JUNCTION POWER DIVIDER

[75] Inventors: Aare Kivi, Massapequa, N.Y.; Louis Feit, Fairlawn, N.J.

[73] Assignee: International Telephone and Telegraph Corporation, Nutley, N.J.

[22] Filed: Jan. 7, 1976

[21] Appl. No.: 647,019

[52] U.S. Cl. ..... 333/9; 333/33

[51] Int. Cl.[2] ..... H01P 5/12

[58] Field of Search ..... 333/1.1, 6, 8, 9, 33

[56] References Cited

UNITED STATES PATENTS 3,174,116 3/1965 Sur ..... 333/1.1

*Primary Examiner*—Paul L. Gensler

*Attorney, Agent, or Firm*—John T. O'Halloran; Alfred C. Hill

[57] ABSTRACT

A disc interconnects the inner conductors of three coaxial transmission line sections of a coaxial transmission line power divider.

8 Claims, 6 Drawing Figures

COAXIAL DISC-JUNCTION POWER DIVIDER

BACKGROUND OF THE INVENTION

This invention relates to power dividers and more particularly to a coaxial transmission line power divider.

The coaxial transmission line T-junction power dividers are well known and in modified form they have been employed in strip-line and microstrip transmission line junction designs. Another form of a coaxial transmission line T-junction power divider utilizes a ring-junction for the inner conductors of the three coaxial transmission line sections forming the power divider. The ring-junction power divider is employed at higher microwave frequencies than the conventional T-junction power divider in coaxial transmission line or strip-line transmission line power dividers where the ring configuration of the junction offers improved symmetry.

The T- or ring-junction power dividers alone do not provide optimum transmission, since they are non-symmetrical and do not provide capacitive or low impedance for impedance matching purposes. Usually these devices are designed with single or multiple impedance transformer sections for low reflection coefficient and optimum transmission coefficient characteristics. Also a T-junction power divider in coaxial transmission line, strip-line transmission line or microstrip transmission line configuration is used with shunt and/or series resistive loading to provide the above-mentioned reflection and transmission characteristics.

SUMMARY OF THE INVENTION

An object of the present invention is to provide a coaxial transmission line power divider having symmetry and capacitive or low shunt impedance for impedance matching purposes.

Another object of the present invention is to provide a symmetrical coaxial transmission line power divider with a capacitive junction impedance.

A feature of the present invention is the provision of a coaxial transmission line power divider comprising: three coaxial transmission lines extending outwardly from a junction area, each of the transmission lines having an outer conductor and an inner conductor, and a disc disposed at the junction area to interconnect the inner conductors of the three transmission lines, the outer conductors of the three transmission lines being interconnected to surround the disc.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
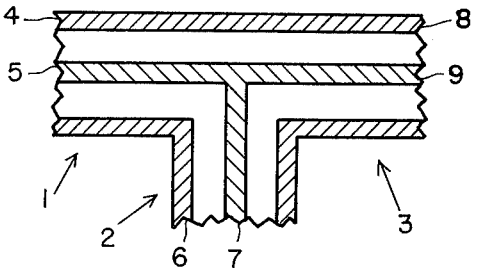
Fig. 1 (PRIOR ART)
FIG. 1 is a cross-sectional view of a coaxial transmission line T-junction power divider of the prior art.

Referring to FIG. 1 there is illustrated a coaxial transmission line T-junction power divider of the prior art including three coaxial transmission line sections 1, 2 and 3. Section 1 has an outer conductor 4 and an inner conductor 5, section 2 has an outer conductor 6 and an inner conductor 7 and section 3 has an outer conductor 8 and an inner conductor 9. To form the T-junction power divider outer conductors 4, 6 and 8 and inner conductors 5, 7 and 9 are directly connected to each other as illustrated. As pointed out above such a T-junction power divider does not have symmetry and alone does not provide optimum transmission.

Figure 2:
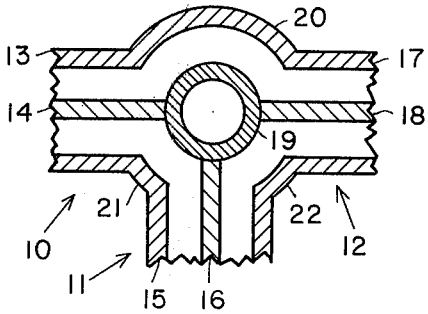
Fig. 2 (PRIOR ART)
FIG. 2 is a cross-sectional view of a coaxial transmission line ring-junction power divider of the prior art.

Referring to FIG. 2 there is illustrated a coaxial transmission line ring-junction power divider of the prior art including three coaxial transmission line sections 10, 11 and 12. Section 10 has an outer conductor 13 and an inner conductor 14, section 11 has an outer conductor 15 and an inner conductor 16 and section 12 has an outer conductor 17 and an inner conductor 18. A ring 19 is employed at the inner conductor junction to interconnect inner conductors 14, 16 and 18 while conductor segments 20, 21 and 22 are employed to interconnect outer conductors 13, 15 and 17. As pointed out above such a ring-junction power divider has improved symmetry but alone does not provide optimum transmission.

Referring to FIGS. 3 – 6 there is illustrated therein the improved coaxial transmission line power divider in accordance with the principles of the present invention. The improved power divider includes three coaxial transmission line sections 23, 24 and 25. Section 23 has an outer conductor 26 and an inner conductor 27, section 24 has an outer conductor 28 and an inner conductor 29 and section 25 has an outer conductor 30 and an inner conductor 31. A disc 32 is employed at the inner conductor junction to interconnect inner conductor 27, 29 and 31 while conductor segments 33, 34 and 35 are employed to interconnect outer conductors 26, 28 and 30.

Figure 3:
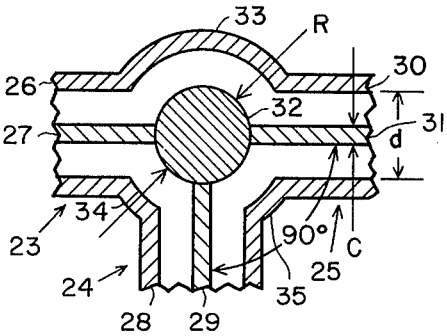
FIG. 3 is a top cross-sectional view of one embodiment of a coaxial transmission line disc-junction power divider in accordance with the principles of the present invention.
Figure 4:
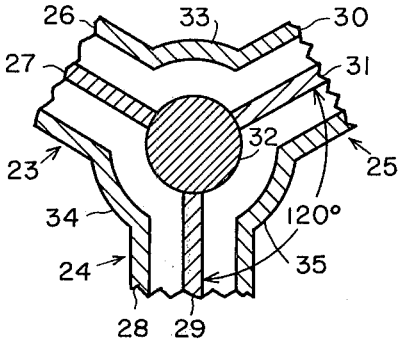
FIG. 4 is a top cross-sectional view of another embodiment of a coaxial transmission line disc-junction power divider in accordance with the principles of the present invention.
Figure 5:
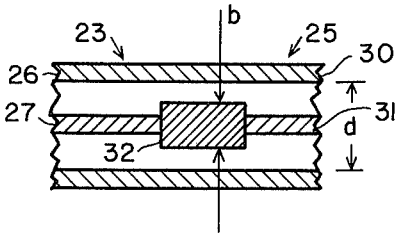
FIGS. 5 and 6 are side cross-sectional views of a coaxial transmission line disc-junction power divider in accordance with the principles of the present invention.
Figure 6:
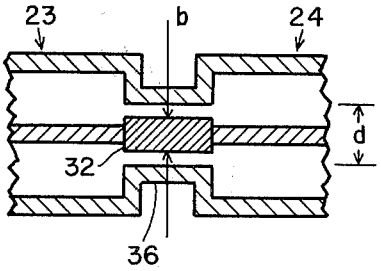

FIG. 3 illustrates that the sections 23, and 25 have a 90° relationship with section 24 while FIG. 4 illustrates that sections 23, 24 and 25 have a 120° relationship with each other. FIGS. 3, 5 and 6 illustrate some of the critical dimensions to be discussed hereinbelow of the improved coaxial transmission line disc-junction power divider of the present invention. In addition FIG. 6 illustrates that in the region of disc 32 the separation between the outer surface of disc 32 and the inner surface of the outer conductors of the coaxial transmission line sections and also the diameter of the inner surface of the outer conductor can be changed by providing a depression 36 in the outer conductors of the coaxial transmission line sections. This arrangement is one embodiment illustrating how to change the dimension *d* and the separation between the outer surface of disc 32 and the inner surface of the outer conductor in the region of disc 32 and, thereby, change the junction impedance and the junction capacitance. Note advantages (5) and (6) hereinbelow.

The following proportionality factor exists for the disc-junction power divider $3 \times C \leq R \leq 6 \times C$ where $C$ = the diameter of the inner conductor and $R$ = the diameter of the disc (note FIG. 3).

The advantages of the disc-junction power divider over the T-junction or ring-junction power dividers are (1) it provides equal or improved symmetry by virtue of the disc configuration, (2) it is simple to manufacture, (3) it provides low shunt impedance or high junction capacitance for reactive inductive matching, (4) it is part of the junction configuration, (5) its junction impedance is proportional to the $d/b$ ratio, where $b$ = the thickness of the disc and $d$ = the diameter of the inner surface of the outer conductor (note FIGS. 5 and 6), and (6) its junction capacitance is proportional to the cross-sectional area of the disc and inversely proportional to the separation between the outer surface of the disc and the inner surface of the outer conductor.

While we have described above the principles of our invention in connection with specific apparatus it is to be clearly understood that this description is made only by way of example and not as a limitation to the scope of our invention as set forth in objects thereof and in the accompanying claims.

We claim:

1. A coaxial transmission line power divider consisting of:

three coaxial transmission lines extending outwardly from a junction area, each of said transmission lines having an outer conductor and an inner conductor, and a solid single element metallic disc disposed at said junction area directly connected to said inner conductors of said three transmission lines, said outer conductors of said three transmission lines being directly interconnected to each other to surround said disc.

2. A power divider according to claim 1, wherein said disc has a diameter that lies between three and six times the diameter of one of said inner conductors.

3. A power divider according to claim 2, wherein said disc provides said power divider with a junction impedance proportional to the ratio of the inner diameter of one of said outer conductor adjacent said disc to the thickness of said disc.

4. A power divider according to claim 3, wherein said disc provides said power divider with a junction capacitance directly proportional to the cross-sectional area of said disc and inversely proportional to separation between the outer surface of said disc and the inner surface of one of said outer conductors.

5. A power divider according to claim 1, wherein said disc provides said power divider with low shunt impedance for reactive inductive matching.

6. A power divider according to claim 1, wherein said disc provides said power divider with high junction capacitance for reactive inductive matching.

7. A power divider according to claim 1, wherein said disc provides said power divider with a junction impedance proportional to the ratio of the inner diameter of one of said outer conductor adjacent said disc to the thickness of said disc.

8. A power divider according to claim 1, wherein said disc provides said power divider with a junction capacitance directly proportional to the cross-sectional area of said disc and inversely proportional to separation between the outer surface of said disc and the inner surface of one of said outer conductors.

* * * * *